US005924636A

United States Patent [19]

Calderon

[11] Patent Number: 5,924,636

[45] Date of Patent: Jul. 20, 1999

[54] PILL CRUSHER

[76] Inventor: Cecilia B. Calderon, 26 E. Mount Vernon Pl., Baltimore, Md. 21202

[21] Appl. No.: 08/982,133

[22] Filed: Dec. 1, 1997

[51] Int. Cl.[6] ..... B02C 19/08

[52] U.S. Cl. ..... 241/84.3; 241/95; 241/169; 241/169.2

[58] Field of Search ..... 241/168.95, 169.2, 241/169, DIG. 27, 219, 199.9, 199.11, 205, 201, 84.3

[56] References Cited

U.S. PATENT DOCUMENTS

| | | | |
|---|---|---|---|
| D. 285,966 | 9/1986 | Porter . | |
| D. 337,828 | 7/1993 | Gordon . | |
| 979,364 | 12/1910 | Baudement et al. . | |
| 2,631,786 | 3/1953 | Morgan et al. | 241/DIG. 27 |
| 4,003,523 | 1/1977 | Doolittle . | |
| 4,366,930 | 1/1983 | Trombetti | 241/DIG. 27 |
| 5,123,601 | 6/1992 | Lavin et al. . | |
| 5,178,337 | 1/1993 | Lupoli . | |
| 5,464,393 | 11/1995 | Klearman . | |
| 5,478,311 | 12/1995 | Klearman . | |

*Primary Examiner*—Mark Rosenbaum
*Attorney, Agent, or Firm*—David L. Volk

[57] ABSTRACT

An elongated first arm includes a first arm free end and a first arm pivot end. A generally bowl shaped crushing member is disposed near the first arm pivot end. An elongated second arm has a second arm free end and a second arm pivot end. A generally bowl shaped receiving member is positioned near the second arm pivot end and is configured to receive the crushing member therein. A generally ball shaped member is positioned at the first arm pivot end. A socket is positioned at the second arm pivot end and is configured to receive the generally ball shaped member. The first arm is pivotable from a first position wherein the crushing member is out of the receiving member to a second position wherein the crushing member is within the receiving member. The first arm is slidable transversely with respect to the second arm when the crushing member is within the receiving member for crushing of items positioned between the crushing member and the receiving member. The receiving member includes a plurality of apertures there-through for expelling the items as they are crushed.

2 Claims, 4 Drawing Sheets

PILL CRUSHER

BACKGROUND OF THE INVENTION

1. Field of the Invention

The present invention relates to apparatus for administration or use of medicines and pills, particularly to a pill crusher.

2. Description of the Related Art

Medications and dietary supplements are often available in pill form only. Some persons, who wish or need to take these items, have an aversion to pills, or find them difficult or impossible to swallow. To overcome this disadvantage, these people generally have to find some way to crush the pills, then mix the crushed pills with water, and drink the mixture. This procedure can be cumbersome and messy.

What is needed is a device which quickly and easily crushes pills, and which makes easy the transferring of the crushed pills into a receptacle for mixing with water.

SUMMARY OF THE INVENTION

The pill crusher of the present invention includes an elongated first arm having a first arm free end and a first arm pivot end. A generally bowl shaped crushing member is disposed near the first arm pivot end. An elongated second arm has a second arm free end and a second arm pivot end. A generally bowl shaped receiving member is positioned near the second arm pivot end and is configured to receive the crushing member therein.

A generally ball shaped member is positioned at the first arm pivot end. A socket is positioned at the second arm pivot end and is configured to receive the generally ball shaped member. The first arm is pivotable from a first position wherein the crushing member is out of the receiving member to a second position wherein the crushing member is within the receiving member.

The first arm is slidable transversely with respect to the second arm when the crushing member is within the receiving member for crushing of items positioned between the crushing member and the receiving member. The receiving member includes a plurality of apertures there-through for expelling the items as they are crushed.

DETAILED DESCRIPTION

Figure 1:
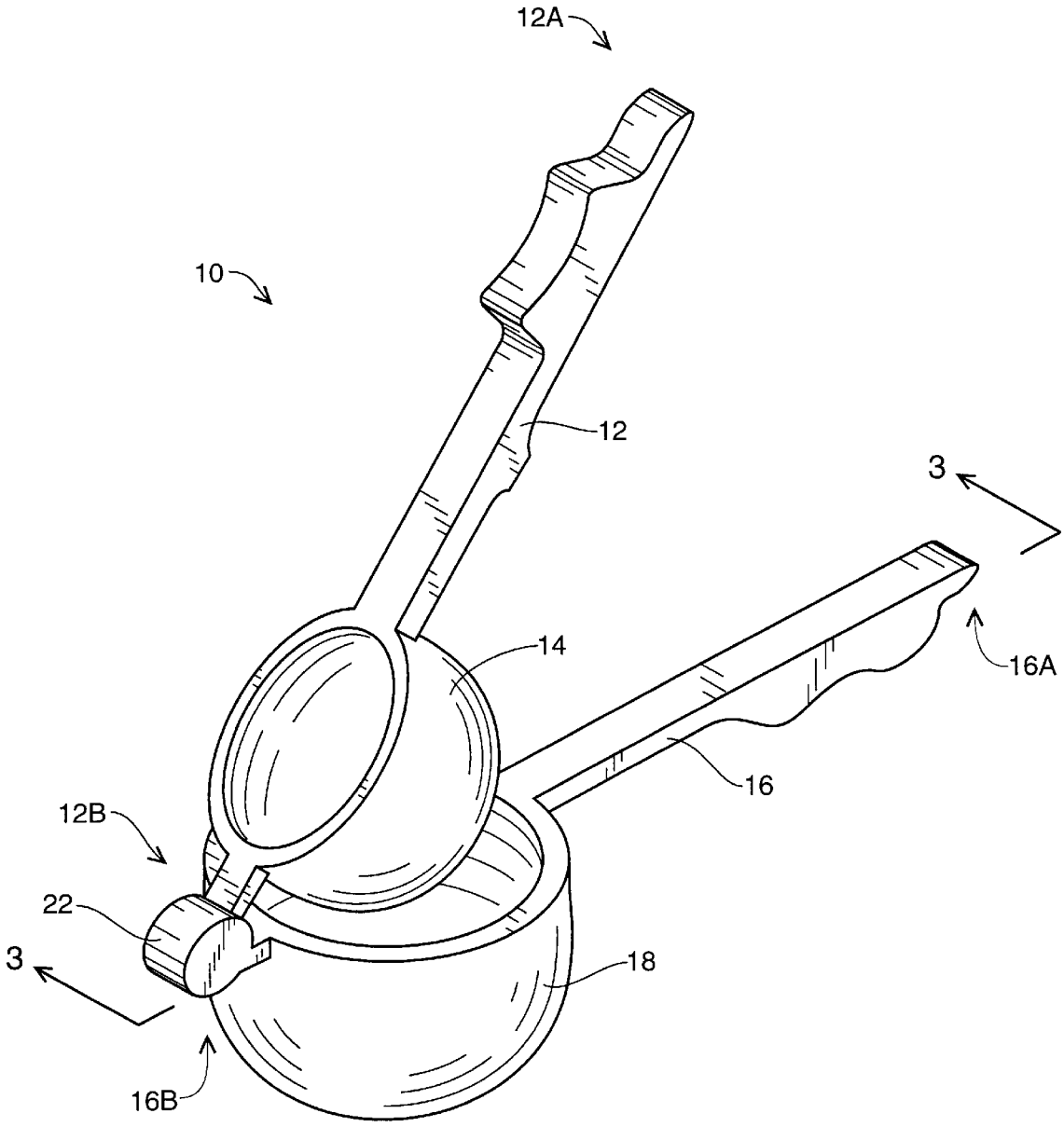
FIG. 1 is a perspective view of a pill crusher of the present invention, in an open position.

FIG. 1 is a perspective view of a pill crusher 10 of the present invention, in an open position. The pill crusher 10 includes an elongated first arm 12 having a first arm free end 12A and a first arm pivot end 12B. A generally bowl shaped crushing member 14 is disposed near the first arm pivot end 12B. An elongated second arm 16 has a second arm free end 16A and a second arm pivot end 16B. A generally bowl shaped member 18 is positioned near the second arm pivot end 16B.

Figure 2:
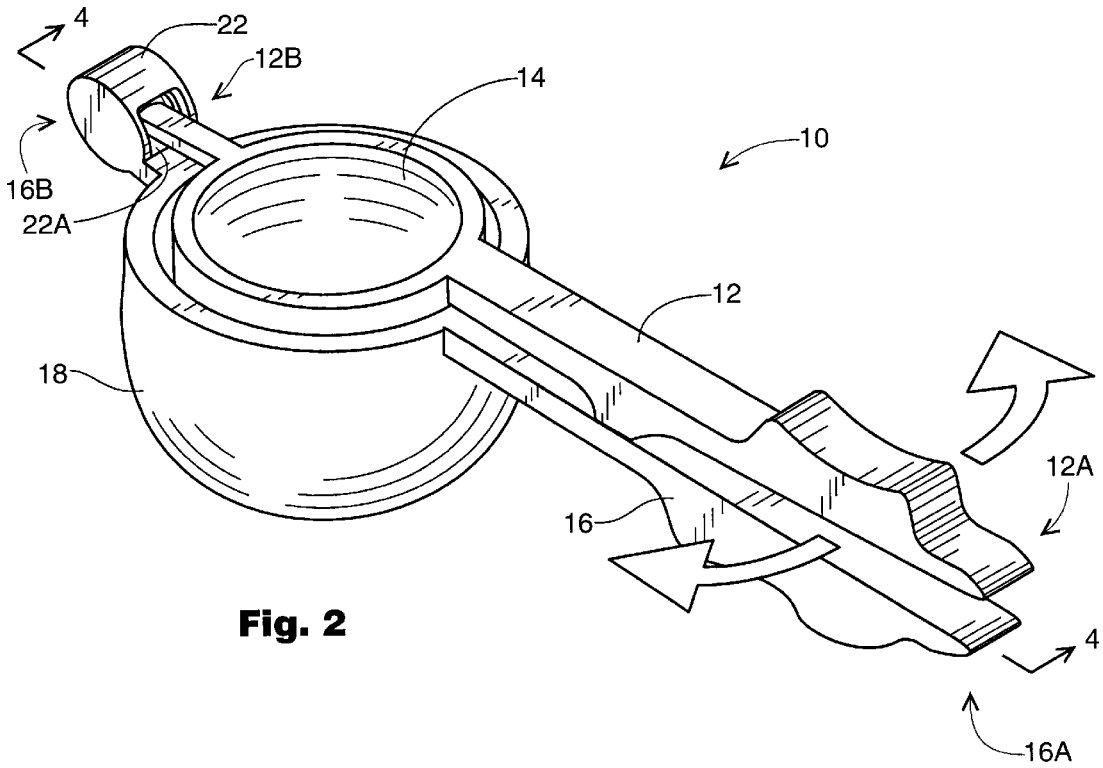
FIG. 2 is a perspective view of the pill crusher in a closed position.

FIG. 2 is a perspective view of the pill crusher 10 in a closed position. The receiving member 18 is configured to receive the crushing member 14 therein.

Figure 3:
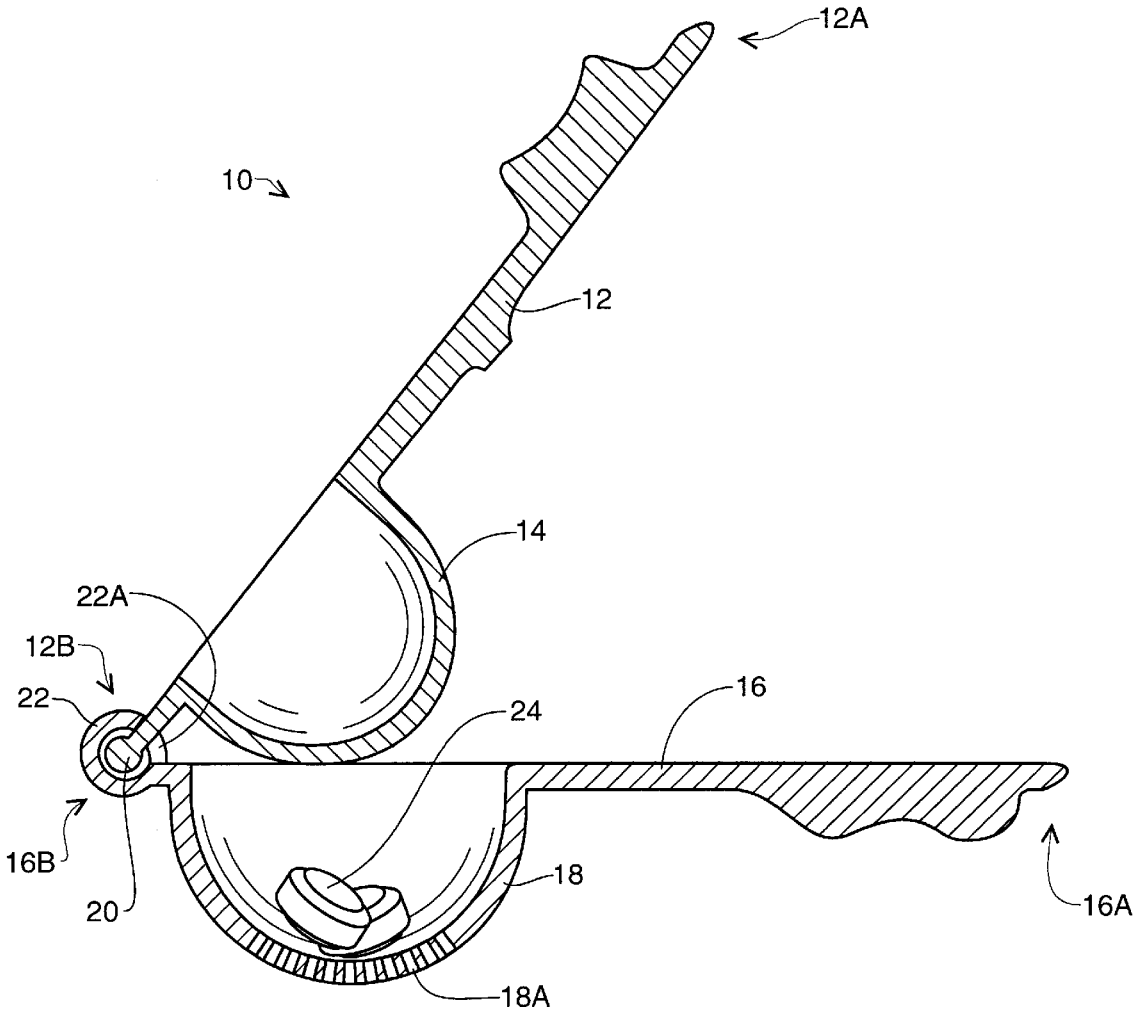
FIG. 3 is a cross-sectional view of the pill crusher, taken along line 3—3 of FIG. 1.

FIG. 3 is a cross-sectional view of the pill crusher 10, taken along line 3—3 of FIG. 1. Referring to FIGS. 1, 2 and 3, a generally ball shaped member 20 is positioned at the first arm pivot end 12B. A socket 22 is positioned at the second arm pivot end 16B and is configured to receive the generally ball shaped member 20. The first arm 12 is pivotable from a first position wherein the crushing member 14 is out of the receiving member 18 to a second position wherein the crushing member 14 is within the receiving member 18.

The first arm 12 extends outwardly from the socket 22 through a slot 22A, which is sufficiently wide to permit the first arm 12 to be slidable transversely with respect to the second arm 16. This facilitates crushing of items such as pills 24 positioned between the crushing member 14 and the receiving member 18. The arrows on FIG. 2 near the first arm free end 12A show the directions in which the first arm 12 is slidable. A user may manipulate the first arm 12 to cause the crushing member 14 to move back and forth relative to the receiving member 18, to aid in crushing the pills 24 between the crushing member 14 and the receiving member 18.

Figure 4:
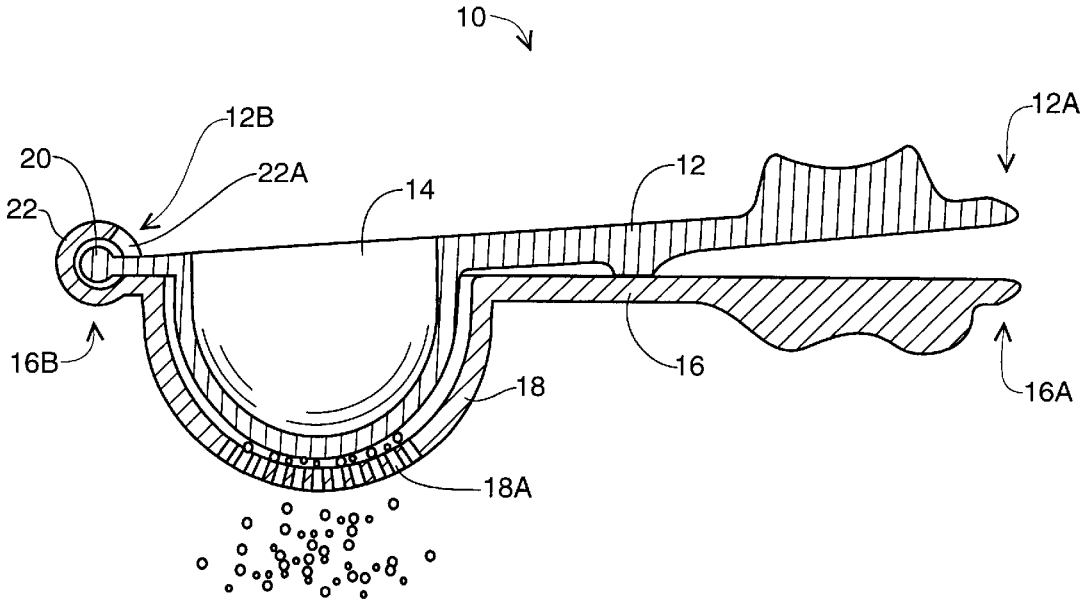
FIG. 4 is a cross-sectional view of the pill crusher, taken along line 4—4 of FIG. 1.
Figure 5:
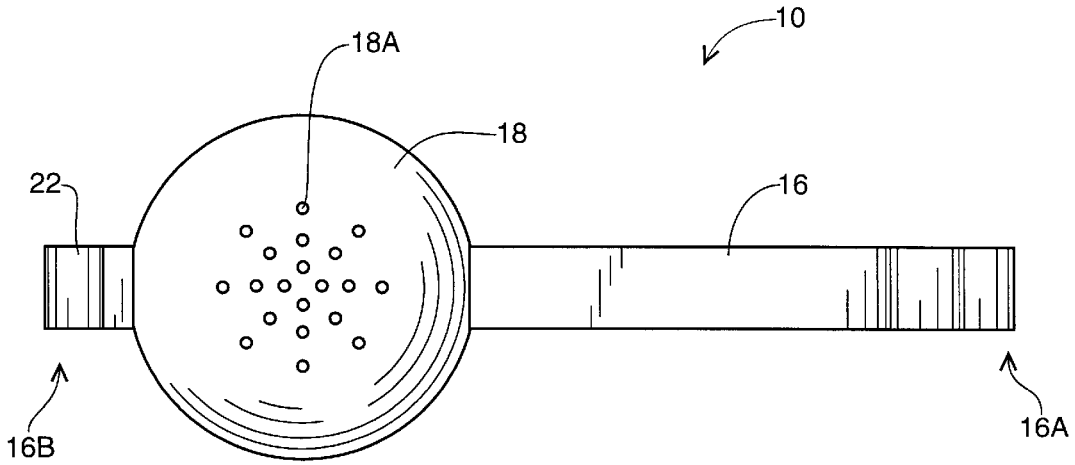
FIG. 5 is a bottom elevational view of the pill crusher.

FIG. 4 is a cross-sectional view of the pill crusher 10, taken along line 4—4 of FIG. 1. FIG. 5 is a bottom elevational view of the pill crusher 10. Referring to FIGS. 4–5, the receiving member 18 includes a plurality of apertures 18A there-through for expelling the pills 24 as they are crushed.

To use the pill crusher 10, a person opens the pill crusher 10 and inserts pills 24 or other items to be crushed, inside the receiving member 18. The user then closes the pill crusher 10 so that the crushing member 14 is received within the receiving member 18. The user then slides the first arm 12 back and forth transversely with respect to the second arm 16, causing the crushing member 14 to move back and forth relative to the receiving member 18, thus more fully crushing the pills 24. As the pills 24 are crushed, the crushed pieces become small enough to fall through or to be pushed through the apertures 18A. If the user has placed the receiving member 18 above a glass of water (not shown), the crushed pieces will fall conveniently into the glass as the pills 24 are crushed.

The foregoing description is included to describe embodiments of the present invention which include the preferred embodiment, and is not meant to limit the scope of the invention. From the foregoing description, many variations will be apparent to those skilled in the art that would be encompassed by the spirit and scope of the invention. Accordingly, the scope of the invention is to be limited only by the following claims and their legal equivalents.

The invention claimed is:

1. A hand held crushing device comprising:

a. a first arm having a first arm free end and a first arm pivot end;

b. a crushing member disposed near the first arm pivot end;

c. a second arm having a second arm free end and a second arm pivot end;

d. a receiving member positioned near the second arm pivot end and configured to receive the crushing member therein;

e. a generally ball shaped member positioned at the first arm pivot end;

f. a socket positioned at the second arm pivot end and configured to receive the generally ball shaped member; and g. the first arm pivot end connected to the second arm pivot end such that the first arm is pivotable from a first position wherein the crushing member is out of the receiving member to a second position wherein the crushing member is within the receiving member, and such that the first arm is slidable transversely with respect to the second arm when the crushing member is within the receiving member for crushing of items positioned between the crushing member and the receiving member.

2. A hand held crushing device comprising:

a. an elongated first arm having a first arm free end and a first arm pivot end;

b. a generally bowl shaped crushing member disposed near the first arm pivot end;

c. an elongated second arm having a second arm free end and a second arm pivot end;

d. a generally bowl shaped receiving member positioned near the second arm pivot end and configured to receive the crushing member therein;

e. a generally ball shaped member positioned at the first arm pivot end;

f. a socket positioned at the second arm pivot end and configured to receive the generally ball shaped member, such that the first arm is pivotable from a first position wherein the crushing member is out of the receiving member to a second position wherein the crushing member is within the receiving member;

g. the first arm extending outwardly from the socket through an opening which is sufficiently wide to permit the first arm to be slidable transversely with respect to the second arm when the crushing member is within the receiving member for crushing of items positioned between the crushing member and the receiving member; and h. the receiving member including a plurality of apertures there-through for expelling the items as they are crushed.

* * * * *